US008262377B2

(12) United States Patent
Caillat et al.

(10) Patent No.: US 8,262,377 B2
(45) Date of Patent: Sep. 11, 2012

(54) INJECTION MOLDED SCROLL FORM

(75) Inventors: Jean-Luc M. Caillat, Dayton, OH (US); Kirill M. Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 434 days.

(21) Appl. No.: 12/052,818

(22) Filed: Mar. 21, 2008

(65) Prior Publication Data

US 2008/0247895 A1 Oct. 9, 2008

Related U.S. Application Data

(60) Provisional application No. 60/910,125, filed on Apr. 4, 2007.

(51) Int. Cl.
*F01C 1/02* (2006.01)
*F04C 2/02* (2006.01)
*F04C 18/02* (2006.01)

(52) U.S. Cl. ..... 418/55.2; 418/55.1; 418/55.4

(58) Field of Classification Search ..... 418/55.2, 418/55.4, 152, 179, 55.1
See application file for complete search history.

(56) References Cited

U.S. PATENT DOCUMENTS

| | | | | |
|---|---|---|---|---|
| 4,875,839 | A * | 10/1989 | Sakata et al. | 418/55.2 |
| 5,131,827 | A * | 7/1992 | Tasaka | 418/55.2 |
| 6,998,434 | B2 | 2/2006 | Wadahara et al. | |
| 2004/0077771 | A1 | 4/2004 | Wadahara et al. | |
| 2009/0030090 | A1 * | 1/2009 | Krishnamoorti et al. | 514/772.4 |

FOREIGN PATENT DOCUMENTS

| | | | |
|---|---|---|---|
| CN | 101617122 | A | 12/2009 |
| EP | 1 980 752 | | 10/2008 |
| JP | 63158362 | | 7/1988 |
| JP | 01277693 | A * | 11/1989 |
| JP | 04005492 | A * | 1/1992 |
| JP | 07069015 | B2 * | 7/1995 |
| JP | 07180681 | | 7/1995 |
| JP | 2004-003410 | | 1/2004 |
| JP | 2004003410 | | 1/2004 |
| JP | 2004003410 | A * | 1/2004 |
| KR | 1020030077596 | | 10/2003 |
| WO | WO 2005014708 | A1 * | 2/2005 |
| WO | WO 2006/096203 | | 9/2006 |
| WO | WO 2008/123947 | | 10/2008 |

OTHER PUBLICATIONS

International Preliminary Report on Patentability dated Oct. 15, 2009 regarding International Application No. PCT/US2008/004086.
Written Opinion of the International Searching Authority regarding PCT/US2008/004086 dated Aug. 25, 2008.
International Search Report regarding International Application No. PCT/US2008/004086 dated Aug. 25, 2008.

(Continued)

*Primary Examiner* — Mary A Davis
(74) *Attorney, Agent, or Firm* — Harness, Dickey & Pierce, P.L.C.

(57) ABSTRACT

Scrolls made from injection molding processes are disclosed. The scroll components have a tip seal groove defined within an involute portion of the scroll. Bearing and tip seal engaging plates are integrally molded within base members of the scroll.

20 Claims, 4 Drawing Sheets

OTHER PUBLICATIONS

First Office Action issued by the State Intellectual Property Office of the People's Republic of China on Apr. 20, 2011 for related Chinese Patent Application No. 200880005422.0 (PCT/US2008/004086). English translation provided by Unitalen Attorneys at Law.

Second Office Action issued by the State Intellectual Property Office of the People's Republic of China on Dec. 16, 2011 for related Chinese Patent Application No. 200880005422.0 (PCT/US2008/004086). English translation provided by Unitalen Attorneys at Law.

Third Office Action issued by the State Intellectual Property Office of the People's Republic of China on Jun. 15, 2012 for related Chinese Patent Application No. 200880005422.0 (PCT/US2008/004086). English translation provided by Unitalen Attorneys at Law.

* cited by examiner

INJECTION MOLDED SCROLL FORM

CROSS-REFERENCE TO RELATED APPLICATIONS

This application claims the benefit of U.S. Provisional Application No. 60/910,125, filed on Apr. 4, 2007. The disclosure of the above application is incorporated herein by reference in its entirety.

FIELD

The present disclosure relates generally to compressors and more particularly to compressor components and methods for forming such components.

BACKGROUND

The statements in this section merely provide background information related to the present disclosure and may not constitute prior art.

Dimensional accuracy of scroll components is an important parameter during manufacturing. Scrolls, to optimally perform in a scroll compressor, should minimize leakage, wear, and fracture. Thus accurate final dimensions are important. Scroll components of scroll compressors are frequently manufactured by a molten metal process ("casting"). In one casting method, molten metal, such as liquid gray cast iron, is poured into a cavity, which then solidifies and forms a scroll after solidification is complete. Molds used in the casting process, into which the molten metal flows, are frequently composed of sand, binder, and/or a ceramic coating and may not have full structural rigidity. When the liquid metal contacts the mold wall surfaces, pressure is exerted on the mold, which potentially can cause mold wall expansion. Gray cast iron is prone to solidification expansion, believed to be due in part to having a high carbon or graphite content. Such a phenomenon can contribute to dimensional variation and tolerance increases.

Furthermore, sometimes, a "skin effect" is observed, which is believed to be attributable to the complicated thermodynamic, kinetic and metallurgical/chemical interactions that take place at the interface between the metal and ceramic casting material during solidification and cooling. Such a skin effect may necessitate removal of the modified surface. To accomplish accurate dimensions after casting, often extensive, complicated and expensive machining is used on the raw castings to convert them into a useable scroll.

It would be desirable to improve dimensional accuracy of scroll components produced during manufacturing and/or to reduce the amount of machining and other attendant processing required during the scroll component manufacturing process to improve manufacturing efficiency and product quality.

SUMMARY

In various aspects, the present disclosure provides a scroll component that includes an injection molded scroll form having an involute portion and a base plate portion. In certain aspects, the injection molded scroll form includes a polymer. In certain aspects, the injection molded scroll form is formed of polymer with a plurality of reinforcing material particles dispersed therethrough, thus forming a reinforcement phase within the polymer matrix. In certain aspects, the present disclosure optionally provides one or more wear plates disposed in the base portion of the scroll form.

In other aspects, the present disclosure provides a scroll component including a scroll form having an involute portion that includes a polymer. The involute portion further defines a tip seal groove. A tip seal may be disposed in the tip seal groove, which in certain aspects can be accomplished without requiring machining of the molded tip seal groove. The scroll form has a base plate portion defining a metal bearing and a metal tip seal engaging surface.

In yet other aspects, the present disclosure provides a scroll compressor component including a scroll form having an involute portion including a polymer and defining a molded tip seal groove formed at a terminal end of the involute portion. A tip seal is disposed in the molded tip seal groove, where the tip seal comprises a tribological material. In certain aspects, the base plate portion further has a tip seal engaging surface.

In other aspects, a scroll component is provided that includes a scroll member having an involute portion and a base plate portion. The involute portion includes a polymer and defines a molded tip seal accepting groove, having a tip seal disposed therein. The base plate portion optionally further defines a tip seal engaging surface.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
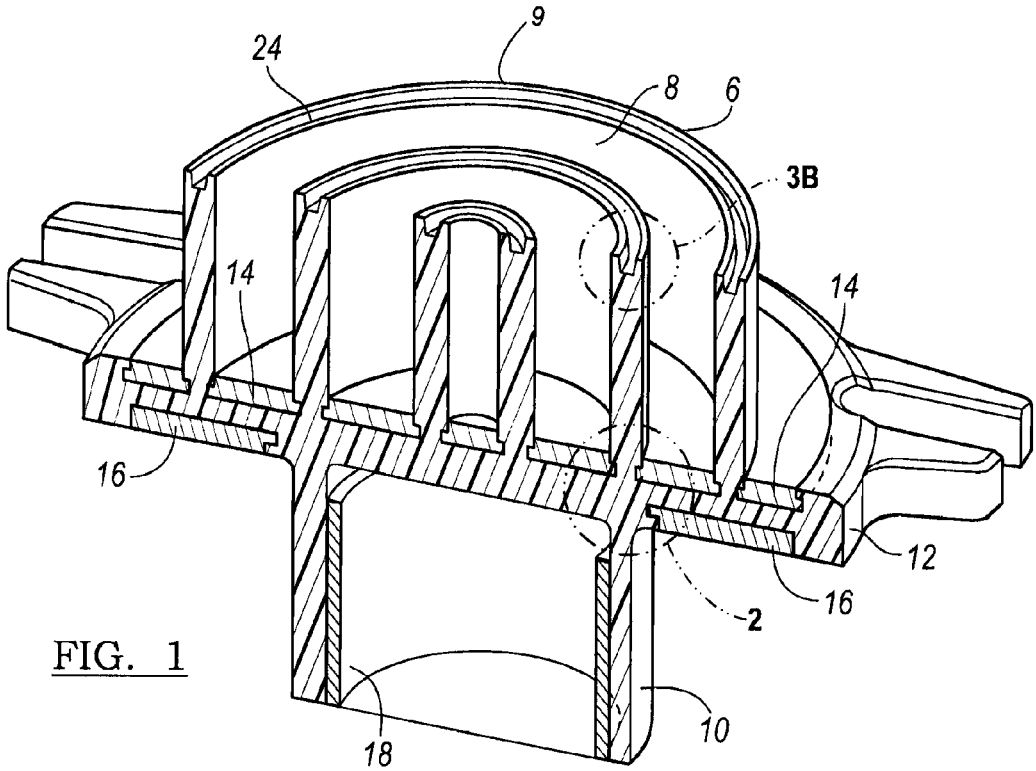
FIG. 1 represents a cross-sectional view of a scroll component according to the teachings of the present invention.

The following description is merely exemplary in nature and is not intended to limit the present disclosure, application, or uses. It should be understood that throughout the drawings, corresponding reference numerals indicate like or corresponding parts and features The present disclosure provides manufacturing processes that enable the manufacturing of a scroll with improved dimensional tolerances, while still meeting the rigorous stress and pressure requirements for a functioning scroll. In various aspects, the disclosure provides for injection molding processes for manufacturing of various near-net shaped scroll components. In various aspects, the scroll form is either formed wholly or formed in component parts which can then be joined to make the entire scroll.

In general, the teachings herein are directed towards the use of injection molded materials, such as polymers, in the formation of a scroll component for a scroll compressor. The entire scroll component may be formed utilizing injection molding techniques. Further, portions of the scroll component may be produced utilizing insert molding techniques.

These portions or inserts can form portions of the scroll's wear surfaces to provide a high degree of dimensional tolerance. The portions may be fastened to other portions of the scroll component using over-molding techniques. These portions are formed by a variety of techniques known in the art, such as casting, forging, and/or injection molding, to provide the desired tribological properties.

FIG. 1 represents a perspective cross-sectional view of a scroll component 6 according to the teachings of the present disclosure. The scroll component form 6 includes a scroll involute portion 8, a hub portion 10, and a scroll base portion 12. As further described below, the scroll base portion 12 optionally has a tip engaging wear plate 14 and/or a bearing engaging wear plate 16. Further, the hub portion 10 has an optional hub bearing cylinder wear plate 18.

Figure 2:
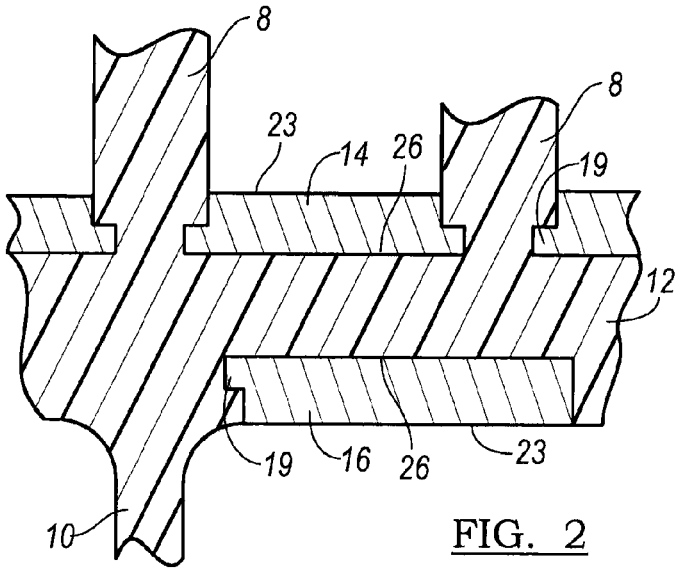
FIGS. 2-3B represent detailed features shown in FIG. 1.

As best seen in FIG. 2, the scroll base portion 12 has the tip engaging wear plate 14 and bearing engaging wear plate 16. Such wear plates are optionally integrally molded with the scroll base portion 12, as will be described below. Disposed on peripheral edges of the tip engaging wear plate 14 and bearing engaging wear plate 16 are optional locking features or flanges 19. These locking features 19 function to fix the location of the tip engaging wear plate 14 and bearing engaging wear plate with respect to the scroll base portion 12. In this regard, both the tip engaging wear plate 14 and bearing engaging wear plate 16 have bearing surfaces 23 and interface intermediate surfaces 26. In various aspects, the bearing surfaces 23 have desirable tribological properties, for example, equal or superior to those of conventional journal bearing materials, such as bronze bearings or polytetrafluoroethylene (PTFE)-impregnated bearings. In certain aspects, the relative location of the bearing surfaces 23 to an opposing tip on an opposing scroll is controlled during the manufacturing of the scroll component 6. In this regard, it is envisioned that the bearing surfaces 23 can either be used as-molded or may optionally be the subject of post-molding metal work.

Figure 3A:
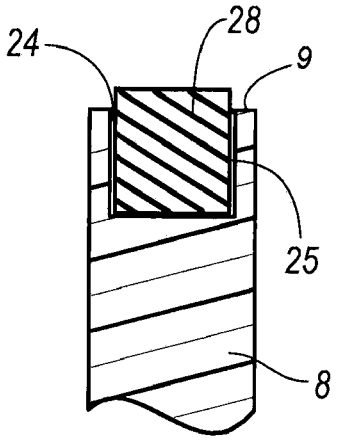
Figure 3B:
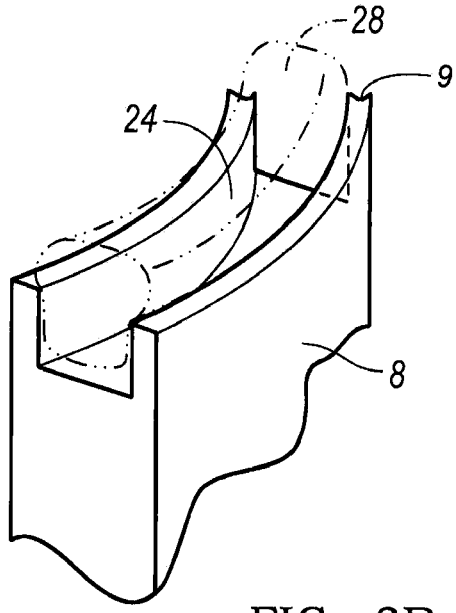

FIGS. 3A and 3B show the scroll involute portion 8 has tips 9 in a terminal end of the involute scroll portion 8. A tip seal groove 24 is formed in tips 9, which is configured to engage, receive, and hold a tip seal 28 within. In certain aspects, the scroll involute portion 8 is integrally formed and molded, for example by injection molding. While the tip seal groove 24 shown in FIGS. 3A and 3B has a pair of angled depending sides 25, it is envisioned that the tip seal groove 24 can additionally take other configurations. In this regard, it is envisioned that the tip seal groove 24 may have a pair of generally parallel engaging surfaces 25 or may also have a locking feature (not shown) molded therein. The tip seal groove 24 can be molded and shaped via the mold cavity shape during the injection molding formation process, in other words, the tip seal accepting groove 24 can be in a "molded form," or in some aspects, can further be machined to achieve the desired shape of the tip seal accepting groove 24. In certain aspects of the disclosure, injection molding with a polymeric material enables formation of molded tip seal grooves having desirable dimensions, eliminating any need for further machining. It may be engaged in the tip seal groove 24 by friction fit or other means known to those of skill in the art. Tip seals 28 are optionally formed of suitable tribological materials known in the art and by way of non-limiting example, may be formed of metal (e.g., parallel metal shims) or polymers (e.g., carbon reinforced PTFE).

Figure 4:
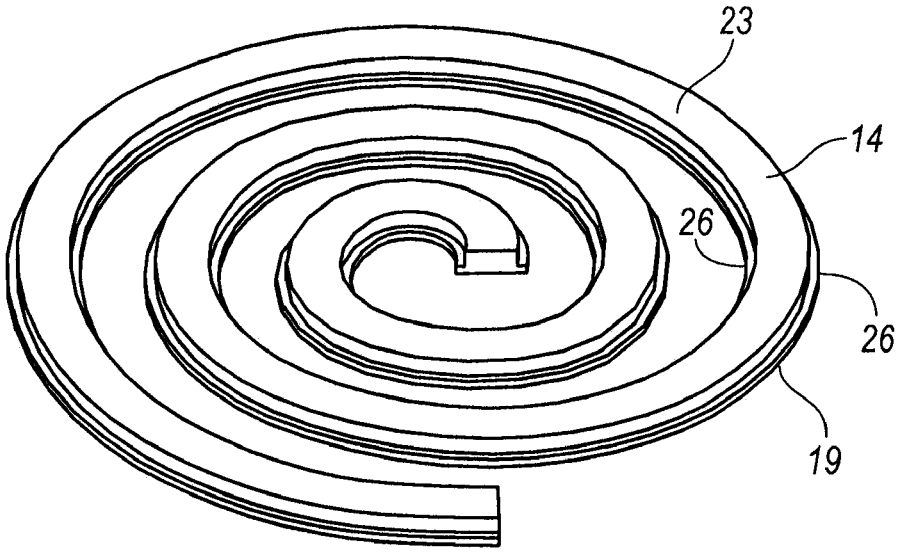
FIG. 4 represents a perspective view of a wear plate as shown in the scroll component of FIG. 1.

FIG. 4 represents a perspective view of the tip seal engaging wear plate 14. As can be seen, the tip seal engaging wear plate 14 is generally serpentine in shape and conforms to the shape of the scroll base portion 12 between raised vanes of the scroll involute portion 8. The side and bottom intermediate surfaces 26 of the tip engaging wear plate 14 can be treated to facilitate bonding with the base or matrix material of the scroll base portion 12. In this regard, the intermediate surfaces 26 can be porous or can define a locking feature. Axial sealing between opposing tips 9 and scroll bases 12 of the scroll component forms 6 can be achieved by utilizing flexible tip seals 28, positioned in the grooves 24 on the tips 9 of the scroll members.

Figure 5:
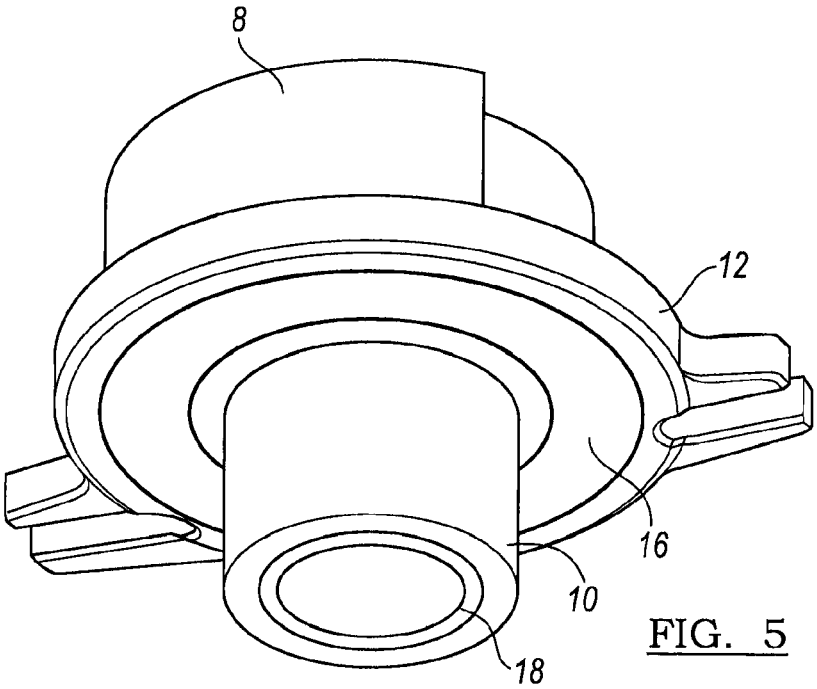
FIG. 5 represents a bottom perspective view of the scroll component shown in FIG. 1.

As shown in FIG. 5, a thrust bearing engaging wear plate 16 is an annular member defined about the hub portion 10 of the lower surface of scroll base portion 12. As with the tip seal engaging bearing wear plate 14, the thrust bearing engaging wear plate 16 can optionally be integrally molded within the scroll base portion 12. Similarly, the optional hub bearing cylinder wear plate 18, for interfacing with a drive member journal, is integrally molded within the hub portion 10. Optionally, the tip engaging wear plate 14, the thrust bearing engaging wear plate 16, and the hub bearing cylinder wear plate 18 can be formed of material with good wear characteristics against interfacing material and vice versa, such as, but not limited to, cast iron, high carbon steel, stainless steel, anodized aluminum and the like.

Figure 6:
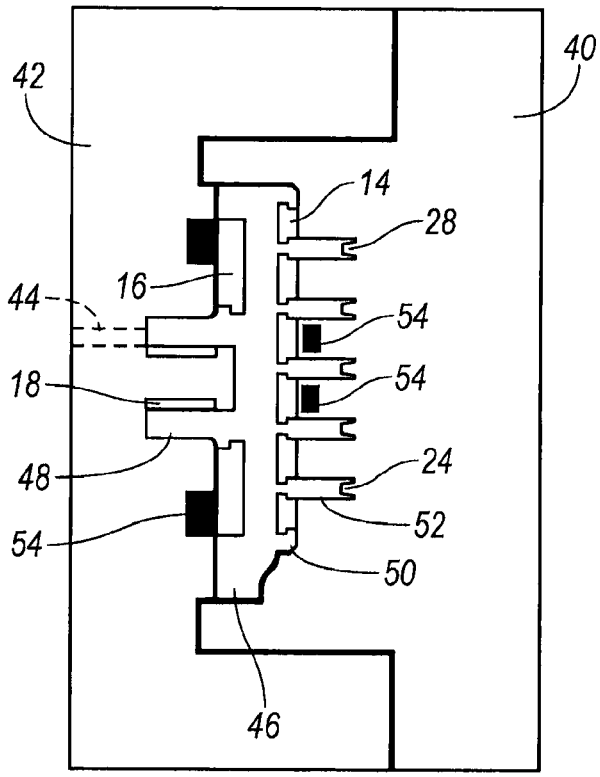
FIG. 6 represents a mold used to form the scroll component shown in FIG. 1.

In certain aspects, a mold such as that shown in FIG. 6 is used to manufacture the scroll component shown in FIG. 1. The mold is formed of first and second halves 40 and 42. The second half 42 defines a gate 44, while a cavity 46 is defined between the first and second portions 40 and 42. The cavity 46 is generally separated into a hub portion 48, a base portion 50, and involute portions 52. Prior to the closing of the mold and molding, the tip engaging wear plate 14 and bearing engaging wear plate 16 are coupled to mold interior surfaces 56 and 58, respectively. A hub bearing cylinder wear plate 18 may be disposed within the hub portion 48.

The tip engaging wear plate 14 and bearing engaging wear plate 16 can be coupled to the tool inner surface using alignment pins (not shown) or optional magnets 54 found within the tool. After the tip engaging wear plate 14 and thrust bearing engaging wear plate 16 are positioned, the mold is closed and fluid is injected into the cavity through gate 44. After the base or matrix material of the component sets, the mold cavity 46 is opened and the scroll component 6 is removed therefrom. It should be understood that the injection molding techniques herein can be used with polymer materials, metal injection molding, or the injection of powder metals utilizing a binder. In certain aspects, the injected material comprises a polymer. In certain aspects, the injected material further comprises a reinforcing material or a reinforcement phase (e.g., forming a composite or a polymer matrix that includes a plurality of particles dispersed within one or more polymer resins). Further, it should be understood that certain components or portions of the scroll may be formed by other conventional processing techniques, such as casting, and the injection molded component(s) can later be joined together with other parts to form an integral scroll.

With respect to the injection molding of polymers, it is envisioned that the polymer material used to form the scroll component 6 can be either a thermoset or a thermoplastic polymer material. In this regard, the thermoset or thermoplastic material can be an engineered plastic such as polymers utilizing reinforcements. In certain aspects, the polymer comprises a polyimide, a copolymer of a polyimide, and/or a derivative or equivalent thereof. As discussed above, such polymer materials optionally comprise a reinforcement phase material to form a matrix. These reinforcements can include, but are not limited to, chopped glass, carbon fiber, polyimide fiber and mixtures thereof. Additionally, it is envisioned that the polymer materials can be reinforced with nano-phase clay (e.g., smectite clays) or carbon micro or nano-tubes, whether single or multi-walled used as reinforcement to form a nano-composite. Other equivalent reinforcement phase materials known or to be developed in the art are also contemplated. In this regard, it is envisioned the carbon micro or nano-tubes (referred to herein as "carbon nanotubes") can be less than or equal to about 5 wt %, or optionally greater than or equal to 1 and less than or equal to 2 wt. % of the total polymer composite weight. In certain aspects, a material modulus is at least 10,000 MPa at an operational temperature up to 300° F., for example. An example of a suitable commercially available polyimide polymer for such applications is VESPEL®, available from E.I. duPont Nemours of Wilmington, Del.

Figure 7:
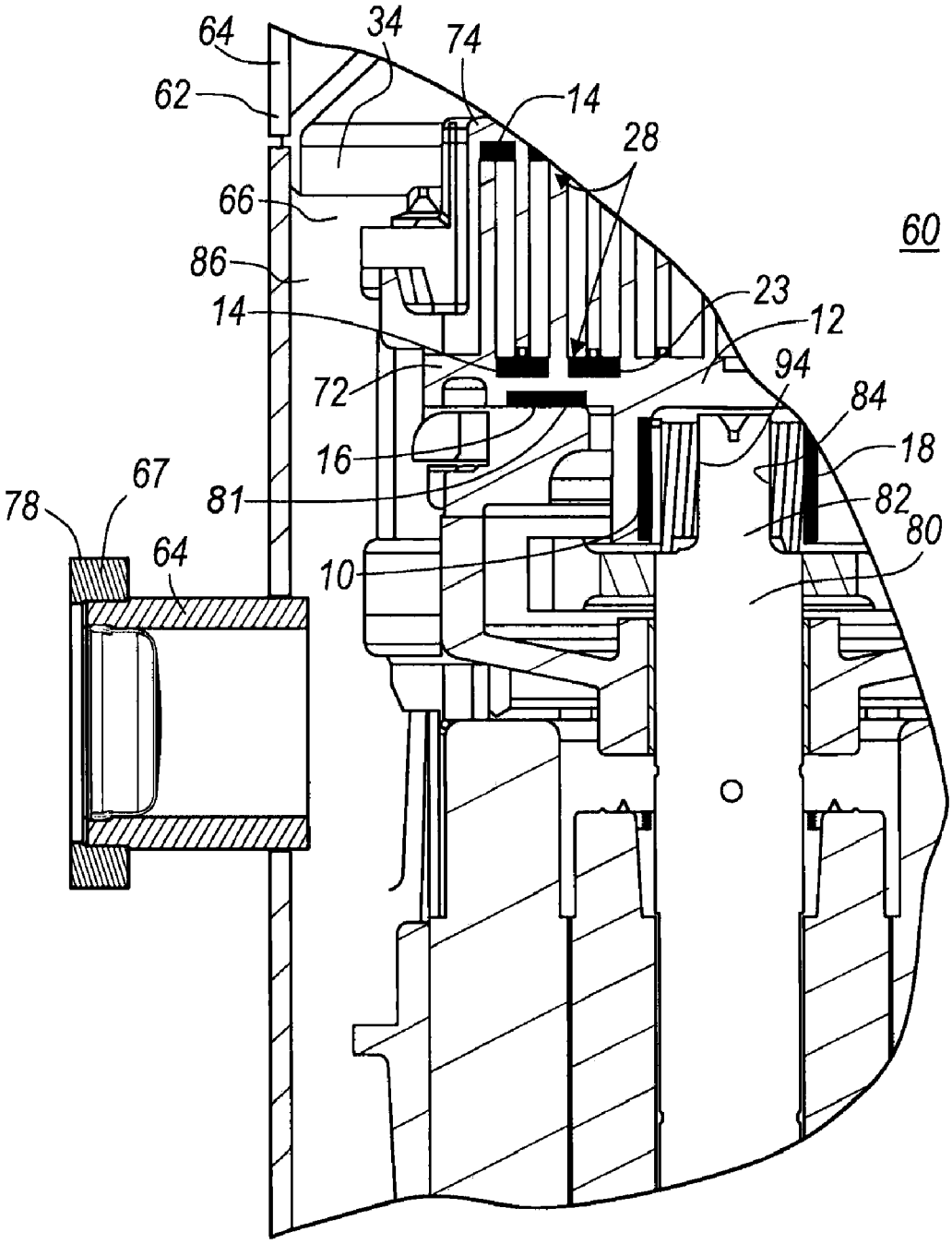
FIG. 7 represents a sectional view of a scroll compressor utilizing the scrolls according to the present teachings.

Shown in FIG. 7 is an exemplary hermetically sealed scroll compressor 60 that incorporates the injection molded scroll members in accordance with the present disclosure. Compressor 60 includes a compressor body 62, a cap assembly 64, a main bearing housing 66, a drive and an oil pump assembly (not shown), an orbiting scroll member 72, and a non-orbiting scroll member 74. The orbiting scroll member 72 and a non-orbiting scroll member 74 define a scroll suction inlet positioned adjacent to the main bearing housing 66 and is located radially inward from the scroll suction inlet 65. The suction fitting 78 is formed by a metal suction plate 67 and suction tube 67'.

Compressor body 62 is generally cylindrical shaped. In certain aspects, the compressor body 62 is constructed from steel. The body 62 defines an internal cavity 86 within which is located main bearing housing 66, and a suction inlet 65 for connecting to a refrigeration circuit (not shown) associated with compressor 60. Compressor body 62 and upper and lower cap assemblies define a sealed chamber 34 within which scroll members 72 and 74 are disposed.

As seen, when in use, the tip seals 28 engage the tip seal bearing surface 23 of the tip seal engaging wear plate 14 of an opposing scroll component. Similarly the bearing engaging wear plate 16 engages an associated bearing 81. The optional hub bearing cylinder wear plate 18 disposed within the hub portion 10 is configured to interface with the bearing sleeve 84. As described above, the tip seals 28 can be formed of parallel metal shims or carbon reinforced polymer PTFE.

A steel drive shaft or crankshaft 80 having an eccentric crank pin 82 at one end thereof is rotatably journaled in a sleeve bearing 84 in main bearing housing 66 and a bearing in lower bearing assembly (not shown). Crank pin 82 is drivingly disposed within inner bore 92 of drive bushing 94. Crank pin 82 has a flat on one surface which drivingly engages a flat surface (not shown) formed to provide a radially compliant drive arrangement, such as shown in commonly assigned U.S. Pat. No. 4,877,382 to Caillat et al., which is hereby incorporated by reference.

What is claimed is:

1. A scroll component comprising:

an injection molded polymer scroll form comprising a base plate portion having an involute portion on a first side and a hub portion formed on a second side of the base plate portion opposite to the first side, wherein the hub portion is capable of receiving a portion of a drive shaft and the polymer scroll form comprises at least one reinforcement phase; and a first metal wear plate integrally molded into the first side of the base plate portion and a second metal wear plate integrally molded into a second side of the base plate portion.

2. The scroll component according to claim 1 wherein the reinforcement phase comprises a material selected from the group consisting of chopped glass, graphite, carbon nanotubes, carbon micro-tubes, nano-phase clay, mixtures, and equivalents thereof.

3. The scroll component according to claim 1 wherein the polymer scroll form comprises a polyimide, a copolymer or derivative thereof.

4. The scroll component according to claim 1 wherein the reinforcement phase comprises less than or equal to about 5 wt % carbon nanotubes in the total composition.

5. The scroll component according to claim 1 wherein the involute portion defines a tip seal accepting groove having a tip seal disposed therein.

6. The scroll component according to claim 5 wherein the tip seal is formed of a tribological metal and/or a tribological polymer.

7. The scroll component according to claim 1 wherein the first metal wear plate is a tip engaging wear plate, the second metal wear plate is a thrust bearing engaging wear plate, and the hub portion of the base plate portion further comprises a hub bearing cylinder wear plate.

8. The scroll component according to claim 1 wherein at least one peripheral edge of the first metal wear plate defines at least one locking feature to join the base plate portion of the polymer scroll form to the first metal wear plate during injection molding.

9. The scroll component according to claim 1, wherein at least a portion of the first metal wear plate or the second metal wear plate that are in contact with the base plate portion is porous to facilitate bonding with the injection molded polymer of the base plate portion.

10. A scroll component comprising:

a scroll form comprising a base plate portion having an involute portion on a first side wherein the scroll form comprises a polymer and a reinforcement phase and defining a molded tip seal groove formed at a terminal end of the involute portion, wherein a material modulus of the scroll form is at least 10,000 MPa at an operational temperature up to 300° F.;

a tip seal disposed in the molded tip seal groove; and a metal wear plate integrally molded into the first side of the base plate portion, wherein the metal wear plate has a serpentine shape and defines a tip seal engaging surface and further comprises at least one peripheral edge that defines at least one locking feature flange to join the base plate portion to the metal wear plate during injection molding.

11. The scroll component according to claim 10 wherein the scroll form further comprises a thrust bearing engaging surface comprising a second metal plate integrally molded into the base portion on a second side opposite to the first side, wherein the second metal plate has an annular shape.

12. The scroll component according to claim 10 wherein the at least one locking feature flange is a first flange and the metal wear plate further comprises a second locking feature flange disposed on a second peripheral edge opposite to the at least one peripheral edge.

13. The scroll component according to claim 10 wherein the metal wear plate comprises a metal selected from the group consisting of cast iron, high carbon steel, stainless steel, anodized aluminum, and mixtures thereof.

14. The scroll component according to claim 10 wherein the polymer of the scroll form comprises a material comprising a polyimide, a copolymer, or derivative thereof.

15. The scroll component according to claim 14 wherein the material further comprises a reinforcement phase selected from the group consisting of chopped glass, graphite, carbon nano-tubes, carbon micro-tubes, nano-phase clay, mixtures and equivalents thereof.

16. The scroll component according to claim 10 wherein the tip seal is formed of one of a plurality of metal shims or a carbon-reinforced polytetrafluorethylene (PTFE) polymer material.

17. A scroll compressor comprising:

a scroll member comprising a base plate portion having an involute portion on a first side and a hub portion formed on a second side of the base plate portion opposite to the first side, wherein the scroll member comprises a polymer and a reinforcement phase, wherein a material modulus of the scroll member is at least 10,000 MPa at an operational temperature up to 300° F., wherein the hub portion is capable of receiving a portion of a drive shaft and the involute portion defines a molded tip seal accepting groove that receives a tip seal; and wherein the first side of the base plate portion comprises an integrally molded metal tip seal engaging surface and the second side of the base plate portion comprises an integrally molded metal thrust bearing engaging surface disposed around the hub portion.

18. The scroll component according to claim 17 wherein the polymer of the involute portion comprises a thermoset polymer and the reinforcement phase material is selected from the group consisting of chopped glass, carbon fiber, polyimide fiber, single walled carbon nano-tubes, multi-walled carbon nano-tubes, carbon micro-tubes, nano-phase clay, mixtures and equivalents thereof.

19. The scroll component according to claim 18 wherein the polymer comprises a polyimide, a copolymer, or derivative thereof and the reinforcement phase material is selected from the group consisting of chopped glass, graphite, a nano-phase clay, carbon nano-tubes, carbon micro-tubes, and mixtures and equivalents thereof.

20. The scroll component according to claim 17, wherein the polymer comprises a polyimide, a copolymer or derivative thereof.

* * * * *